US009744471B1

(12) United States Patent
Fisher

(10) Patent No.: US 9,744,471 B1
(45) Date of Patent: Aug. 29, 2017

(54) LAMINAR JETS FOR WATER PLAY STRUCTURES

(71) Applicant: Skyturtle Technologies Ltd., Enderby (CA)

(72) Inventor: Lance C Fisher, Enderby (CA)

(73) Assignee: Skyturtle Technologies Ltd., Enderby (CA)

( * ) Notice: Subject to any disclaimer, the term of this patent is extended or adjusted under 35 U.S.C. 154(b) by 0 days.

(21) Appl. No.: 14/848,126

(22) Filed: Sep. 8, 2015

Related U.S. Application Data

(60) Provisional application No. 62/046,305, filed on Sep. 5, 2014.

(51) Int. Cl.
*A63H 23/10* (2006.01)
*A63H 23/16* (2006.01)
*A63G 31/00* (2006.01)

(52) U.S. Cl.
CPC ..... *A63H 23/16* (2013.01); *A63G 31/007* (2013.01); *A63H 23/10* (2013.01)

(58) Field of Classification Search
CPC ..... A63H 23/00; A63H 23/10; A63H 23/12; A63H 23/16; A63G 31/00; A63G 31/007
See application file for complete search history.

(56) References Cited

U.S. PATENT DOCUMENTS 5,779,099 A * 7/1998 D'Andrade ..... B05B 1/34 222/79
5,934,563 A * 8/1999 Gapco ..... B05B 3/026 239/251
6,085,988 A 7/2000 Marsh
6,161,771 A * 12/2000 Henry ..... A63G 31/007 239/17
6,319,139 B1 * 11/2001 Tracy ..... A63B 71/02 472/117
6,739,979 B2 * 5/2004 Tracy ..... B05B 17/08 472/117
7,818,826 B2 * 10/2010 Schmidt ..... A61H 33/027 4/541.1
8,215,569 B2 * 7/2012 Johnson ..... B05B 1/34 239/17
2003/0010836 A1 * 1/2003 Pham ..... B05B 1/34 239/17
2005/0155144 A1 * 7/2005 McDonald ..... A61H 9/00 4/507
2006/0253972 A1 * 11/2006 Schmidt ..... A61H 33/6063 4/541.6
2007/0107117 A1 * 5/2007 Casolco ..... E04H 4/0018 4/496
2010/0270402 A1 * 10/2010 Gilpatrick ..... B05B 1/34 239/532
2011/0042489 A1 * 2/2011 Johnson ..... B05B 1/34 239/407
2013/0309618 A1 * 11/2013 Horn ..... F23D 14/58 431/181

* cited by examiner

*Primary Examiner* — Gene Kim
*Assistant Examiner* — Alyssa Hylinski
(74) *Attorney, Agent, or Firm* — Schacht Law Office, Inc.; Dwayne Rogge

(57) ABSTRACT

The present disclosure provides a water play feature that creates a laminar water jet stream, or multiple laminar water jet streams for interaction and display in a water park.

11 Claims, 3 Drawing Sheets

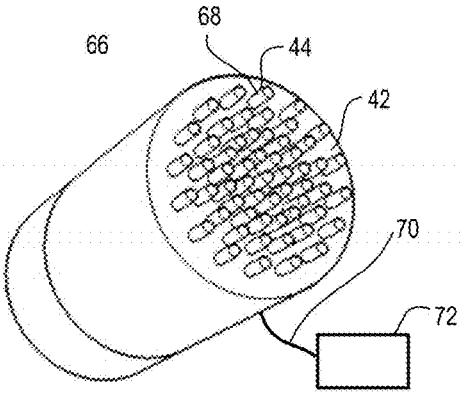
Fig. 5
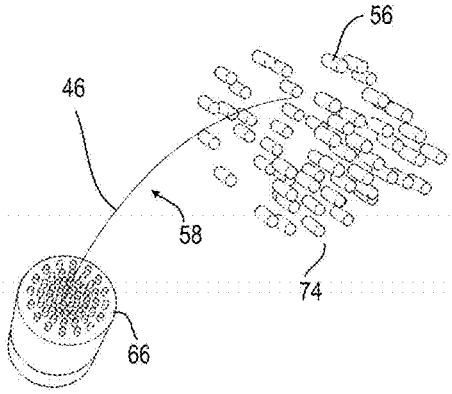
Fig. 6
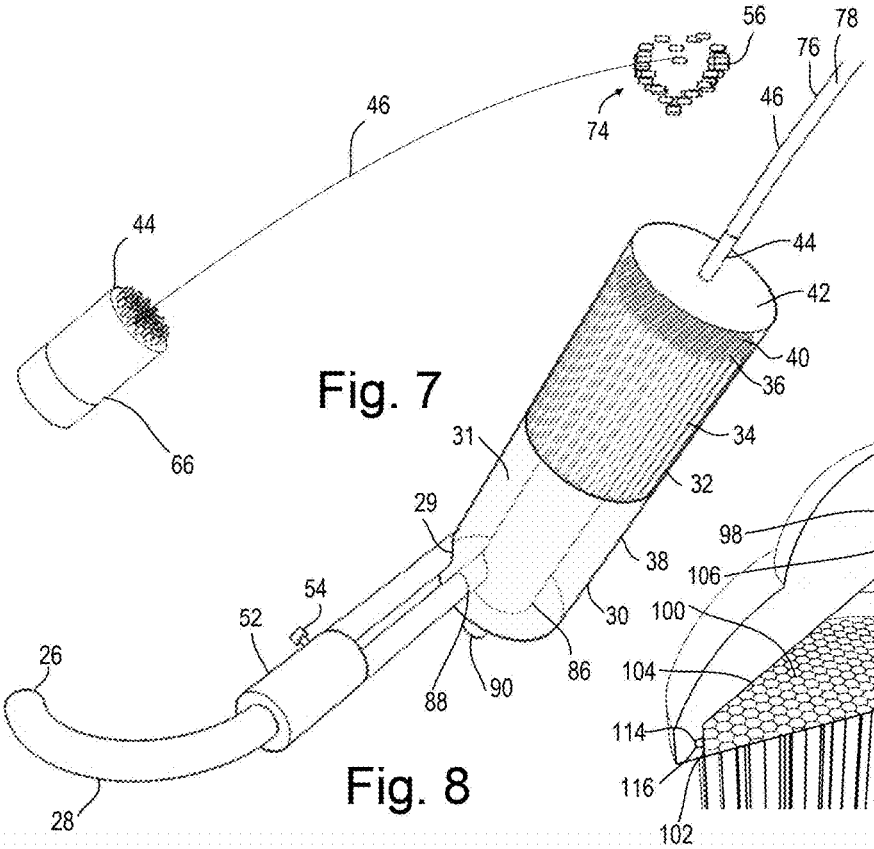
Fig. 7
Fig. 8
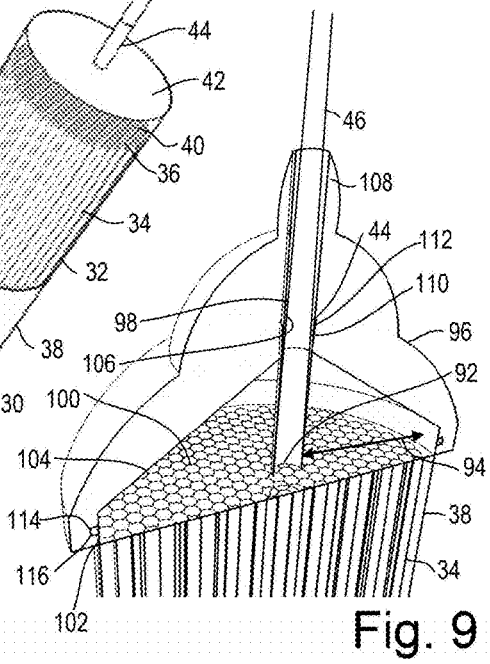
Fig. 9

LAMINAR JETS FOR WATER PLAY STRUCTURES

RELATED APPLICATIONS

This application claims priority benefit of U.S. Provisional Application Ser. No. 62/046,305, filed Sep. 5, 2014, incorporated herein by reference.

BACKGROUND OF THE DISCLOSURE

Field of the Disclosure

This relates to water play structures typically installed in municipalities or waterparks that allow participants to interact with water devices.

BRIEF SUMMARY OF THE DISCLOSURE

Disclosed herein is a water play feature comprising in one example: a water supply source; at least one laminar flow water jet having a nozzle configured to provide a laminar flow water stream for interaction in a water park; and a valve positioned between the water supply source and the laminar flow water jet.

The water play feature may be arranged wherein the laminar flow is turned on and off to interact with participants.

The water play feature may be arranged wherein the laminar flow device is rotated in a horizontal plane to interact with participants.

The water play feature may be arranged wherein the laminar flow device is moved to interact with participants.

The water play feature may comprise a plurality of nozzles forming laminar flow water streams, each nozzle fluidly coupled to a turbulence removing filter portion of the laminar flow water jet.

The water play feature of claim 5, wherein valves are provided on each nozzle forming the laminar flow streams, and these nozzles can turn on and off on an individual basis.

The water play feature may further comprise a lighting device configured to project lighting in the laminar stream.

The water play feature may be arranged wherein the lighting device is configured to project colored lighting is in the laminar stream.

The water play feature may further comprise: a preliminary turbulence filter having: a radially outward outer filter chamber fluidly coupled to the water source via an outer inlet; a radially inward inner filter chamber fluidly coupled to the water source via an inner inlet; wherein the flow of water entering the radially outward outer filter chamber is controlled independent upon the flow of water entering the radially inward inner filter chamber; a laminar flow generator coupled to outlet ends of the radially outward outer filter chamber and radially inward inner filter chamber; and at least one nozzle coupled to the laminar flow generator.

The water play feature may further comprise: a preliminary turbulence filter having an inlet coupled to a water source; a laminar flow generator coupled to the preliminary turbulence filter; wherein the laminar flow generator has a conic end wall at an outlet end thereof. At least one nozzle is coupled to the laminar flow generator and the nozzle having an inlet extending longitudinally into the region radially bounded by the conic end wall; and wherein the nozzle inlet is longitudinally positionable.

The water play feature may further comprise: an adjustment nut rotatably coupled to the laminar flow generator; the adjustment nut having a region of female threads therein; the nozzle having a region of male threads thereon such that as the adjustment nut is rotated relative to the nozzle, the nozzle inlet repositions longitudinally within the region radially bounded by the conic end wall.

The water play feature of may be arranged wherein the nozzle has an inner surface tapered outward from the nozzle inlet.

BRIEF DESCRIPTION OF THE SEVERAL VIEWS OF THE DRAWINGS

FIG. 5 is a front isometric view of one example of the apparatus.

FIG. 6 is a front isometric view of the example shown in FIG. 5 in use.

FIG. 7 is a side isometric view of the components of FIG. 6 in the same relative position.

FIG. 8 is an enlarged view of the example shown in FIG. 1.

FIG. 9 is another example having an adjustable nozzle system.

DETAILED DESCRIPTION OF THE DISCLOSURE

Disclosed herein are several examples of a laminar jet system 20 for a water play structure 22.

Definition of to Laminer Water Flow

Streamlined or laminar flow of water is a flow of water molecules in a column where the molecules passing through the same point in space have the same velocity as laterally adjacent molecules. Laminar flow is different from turbulent flow in which laterally adjacent water molecules flow in a random manner. A laminar flow water jet is a device that is configured to produce a laminar flow of water. A laminar flow water jet reduces or removes water turbulence prior to jetting of a water column in order to make the jetted water column less turbulent than a standard (turbulent) spray nozzle and produce a laminar water column.

Laminar flow water columns are precisely defined laminar (turbulence-free) jets of rapidly moving water that look motionless when properly formed, these laminar water columns look like glass rods bent into parabolas in the regions of laminar flow where the entire cross section of the water column is moving at the same speed without air pockets and turbulence.

Components of a Laminar Flow Jet

A laminar flow jet consists of a turbulence decreasing chamber commonly in the shape of a cylinder supplied with water from a water source and the following components:

Preliminary turbulence remover: In one example this preliminary turbulence remover can be open cell foam or similar structure contained within a housing generally in cylindrical form just downstream of an inlet to the turbulence decreasing chamber. The structure of the open cell foam removes some turbulence.

Laminar flow generator: The water may then be passed from the preliminary turbulence remover through a laminar flow generator having a large number of (generally cylindrical) cylindrical hollow tubes or straws, with each straw producing an approximately laminar column at the downstream end of the straw. These approximately laminar columns combine together to form a single wider water column at an exit terminal.

Laminar nozzle—The laminar nozzle is often designed in V-shape, which forms the jetted water to a laminar water column. This laminar jet then exits through a fine outlet end of the nozzle.

Figure 1:
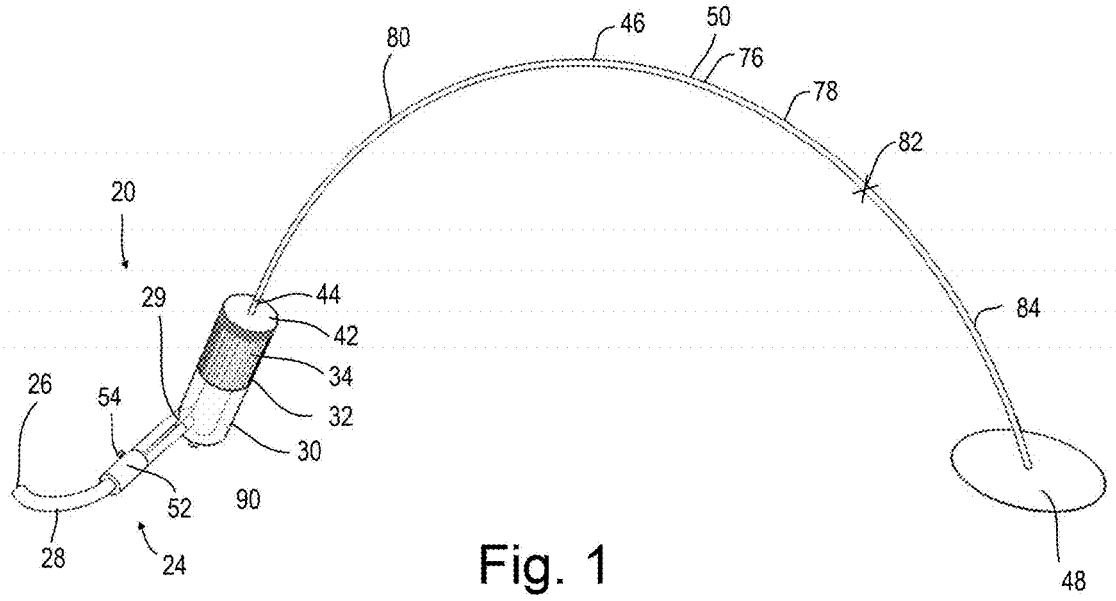
FIG. 1 is a side view of one example of the disclosed apparatus.

FIG. 1 shows a side view of the water source 26, the inlet line 28, the laminar jet device 24 and the laminar water flow 46.

Figure 2:
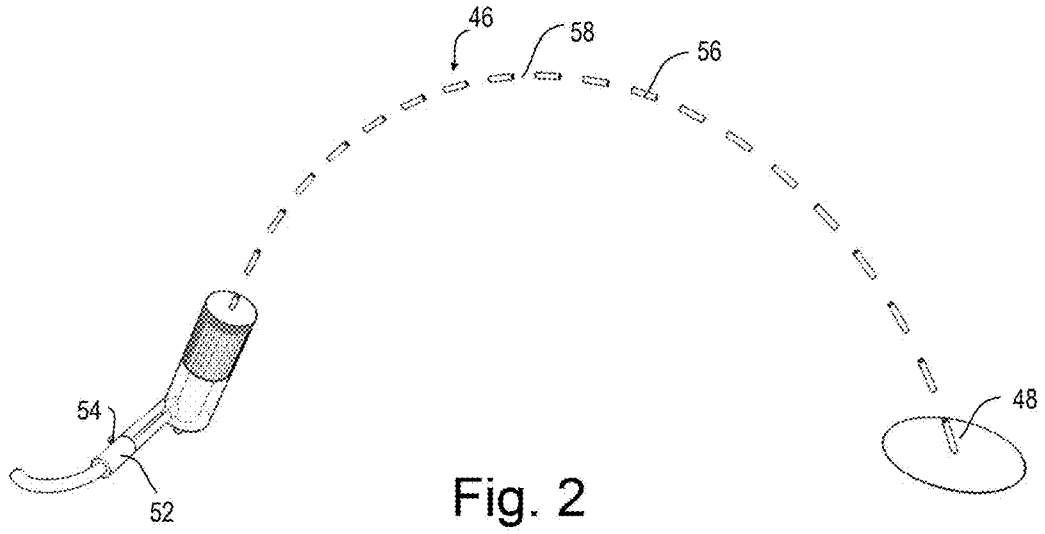
FIG. 2 is a side view of one example of the disclosed apparatus.

FIG. 2 is a side view of the laminar jet device 24, the laminar water flow 46, and a gap 58 created by turning off the flow.

FIG. 7 is a perspective view of a multi laminar jet device 66, the laminar water flow 56, a gap 58 created by turning off and on the flow of water through a nozzle, and the overall 3D (heart) shape 74 created by turning the individual laminar nozzles 44 on and off.

Operation

In one operation example, as previously described, a flow of water is passed through filters and lengths of tubing in order to create a laminar flow. The laminar flow may then be ejected through a nozzle into a water park for interaction by and with the participants. The nozzle may be moved mechanically or manually by a participant to change the flow/destination/target. The flow can be stopped and restarted to create different water effects, some of which will be described by way of examples below.

Shown in the example of FIG. 1, the laminar jet system 20 for a water play structure 22 of this example comprises a laminar flow jet 24 coupled to a water source 26 by way of a conduit 28. The conduit 28 is in fluid communication with at least one inlet 29 of the laminar flow jet 24. In this example, the laminar flow jet 24 comprises a tangential outer cylinder inlet 29 coupling the water source 26 to a preliminary turbulence filter 30. Such preliminary turbulence filters 30 as previously discussed may be comprised of a volume of open cell foam 31 or equivalent structure within an outer housing configured to remove the initial turbulence of the water entering the laminar flow jet 24.

Looking to FIG. 8 it can be seen that in this example, downstream of the preliminary turbulence filter 30 is attached a laminar flow generator 32 in fluid communication with the preliminary turbulence filter 30. The laminar flow generator 32 of this example comprising a number of hollow tubes or straws 34. A mesh plate 36 may be provided at the downstream end thereof, or the individual straws 34 may be otherwise retained in the laminar flow generator 32. For example, the straws 34 may be adhered or otherwise secured to the outer cylinder 38 forming an open region 40 between the straws 34 and an end cap 42. In this example, a nozzle 44 is centered upon the end cap 42. The nozzle 44 provides an outlet for a parabolic stream 46 laminar flow water column. Returning to FIG. 1, it can be seen that the parabolic stream 46 extends from the nozzle 44 towards a target 48.

In use in a water play structure 22 it may be desired to mount the laminar flow jet 24 onto a gimbal (two-axis pivot) or other movable mount to allow a participant to direct the laminar flow 50 to alternate targets 48.

In addition, a valve 52 having an actuator 54 may be provided between the water source 26 and the laminar flow jet 24. The valve 52 and actuator 54 may alternatively be positioned on the nozzle 44. The valve 52 and actuator 54 may alternatively be positioned at alternate points between the water source 26 and nozzle 44 provided that the turbulence potentially generated by the valve 52 is taken into account.

Looking to FIG. 2 is shown an example where the parabolic stream 46 comprises a plurality of parabolic stream segments 56, each segment 56 separated by a gap 58. This gap 58 may be accomplished by manual or automated manipulation of the actuator 54 and valve 52. Such actuation of the valve 52 may be desired in a combination, where a first actuator 54 and first valve 52 are manually actuated to provide pressurized flow of water to the laminar flow jet 24 and a second actuator 54 and second valve 52 are automated to provide gaps 58 between the parabolic stream segments 56. This operation may be greatly desired where it is desired to provide a broken parabolic stream 46 as shown in FIG. 2 for example so as to simulate an automatic weapon firing.

Figure 3:
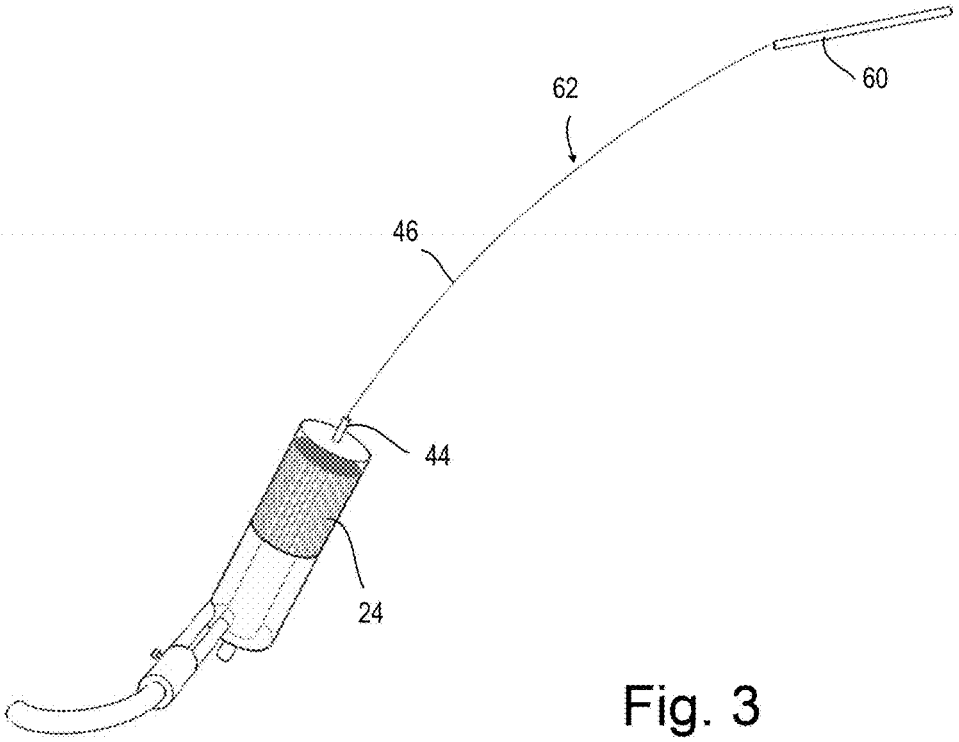
FIG. 3 is a perspective view of one example of the disclosed apparatus.
Figure 4:
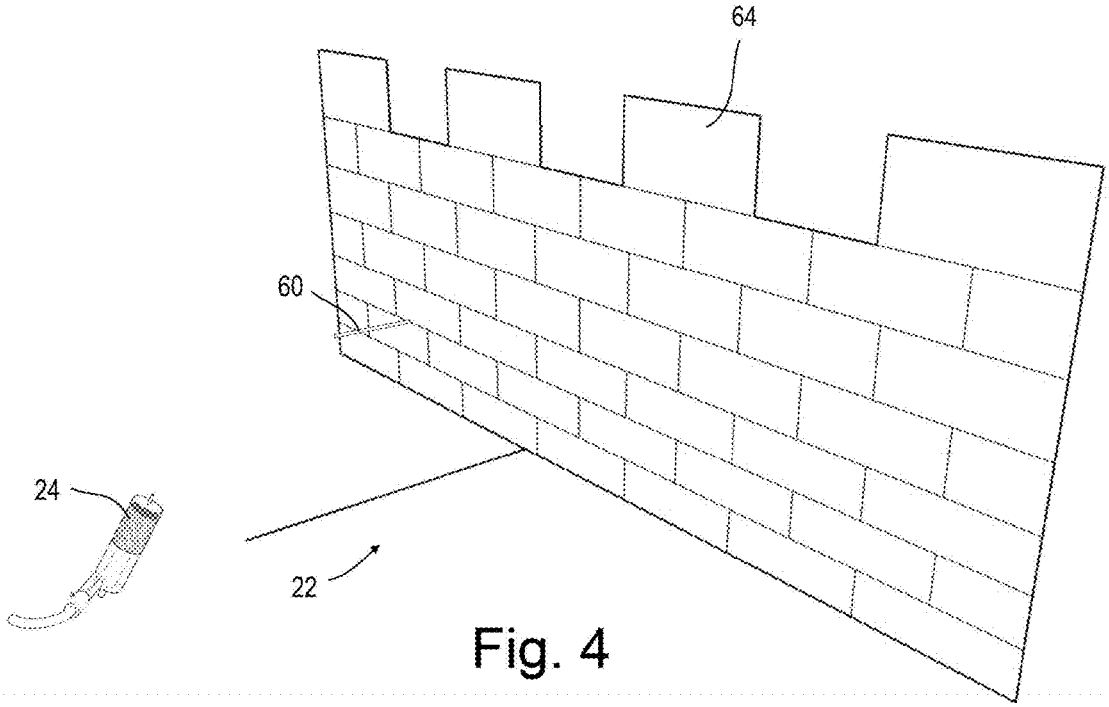
FIG. 4 is an environmental view of the example shown in FIG. 3.

FIG. 3 shows an example where the laminar jet system 20 is configured to fire a simulated projectile 60 which in this example is in the shape of an arrow flying in the parabolic arc 46 from the nozzle 44. Such a shape may be accomplished by careful manipulation of the volume, pressure, and duration of water flow out of the nozzle 44. By providing simulated projectiles 60 separated by large gaps 62, a different simulation may be formed from that disclosed above. This can be especially attractive for example when the target is formed in a theme, such as the castle wall 64 shown in FIG. 4.

FIG. 5 is a perspective view of the multiple nozzle laminar flow jet 66 with a plurality of nozzles 44 mounted to the end cap 42. Each nozzle 44 having a valve or solenoid 68 configured to control the flow of water through the associated nozzle 44. Each valve 68 coupled by way of conduit 70 or wireless (infrared, radio frequency, etc.) to a programmable controller 72.

By independently controlling flow through the nozzles 44 of the example shown in FIG. 5, a three dimensional shape 74 as shown in FIG. 6 may be produced.

FIG. 6 shows one example of one shape, viewing angle, of a three-dimensional shape 74 that may be formed. Although the shape 74 of the individual segments 56 from the angle shown in FIG. 6 appears random, when viewed from a different angle, such as shown in FIG. 7, a three dimensional representation of a heart becomes visible. FIG. 7 is a perspective view of a multi laminar jet device 66, the laminar water flow 56, a gap 58 created by turning off and on the flow of water through a nozzle, and the overall 3D (heart) shape 74 created by turning the individual laminar nozzles 44 on and off in a highly controlled manner. A participant for example may be able to select with the programmable controller 72 a three dimensional shape 74 from a selection of three dimensional shapes 74 such as stars, spades, spheres, etc. and then simultaneously fire a set of parabolic stream segments 56 manipulated by the programmable controller 72 to the selected representative three dimensional shape 74. For example, a star shape may be selected, and this star shape fired in such a way that a participant would view a star coming at them through the air in a parabolic arc.

Returning to FIG. 1 it can be understood that the parabolic stream 46 is a laminar flow water column having an outer surface 76 surrounding an inner core 78. The outer surface 76 being subject to deceleration due to frictional effects with the environmental air. Thus, the parabolic stream 46 will be laminar (equal velocity throughout the cross section thereof) only at a portion of the parabolic stream 46. For ease in description, the parabolic stream 46 of such a laminar flow water column will be described as a pre-laminar flow portion 80, a laminar flow portion 50, a sheer point 82, and a post laminar flow portion 84.

Generally, it is desired to have the laminar flow portion 50 near the top of the parabolic arc so as to maximize the aesthetic appeal and focus attention away from the pre-laminar flow portion 80 and post laminar flow portion 84. To accomplish correct positioning of the laminar flow portion 50 the relative diameter and length of the outer cylinder 38, nozzle 44, and straws 34 may be manipulated. In addition, the longitudinal length of and diameter of the open region 40 between the straws 34 and the nozzle 44 may be maximized to properly position the laminar flow portion 50 in a desired application.

Looking to FIG. 8 is shown an example where the preliminary turbulence filter 30 comprises the outer cylinder 38 (previously described) surrounding and radially outward of an inner cylinder 86. The outer cylinder inlet 29 previously described is in fluid communication with the inner surface of the outer cylinder 38 so as to preliminarily filter turbulence of water provided to a radially outward portion of the straws 34.

The preliminary turbulence filter 30 of this example also comprising an inner inlet 88 in fluid communication with the inner cylinder 86 so as to preliminarily filter turbulence of water provided to a radially inward portion of the straws 34. In this way, the radial flow of water entering the nozzle 44 may be controlled so as to adjust the velocity of the outer surface 76 of the water column relative to the inner core 78. This allows a user to control the relative position of laminar flow portion 50 in the parabolic stream 46. This inner and outer filter configuration in combination with the valve 52 also allows a user to control the relative position of the sheer point 82 on the parabolic stream 46. Thus, a user is able to for example produce a parabolic stream 46 with a sheer point 82 directly above target such as another participant. If properly adjusted, this configuration when properly controlled will result in shearing of the laminar flow 50 above the target, resulting in a somewhat cascade of water thereupon.

In any of the preceding examples, a lighting device 90 such as a light emitting diode (LED), laser, or other light source may be utilized in line with the nozzle 44 so as to project a stream of light down the parabolic stream 46. In such an example, the parabolic stream 46 will act in a similar manner to an optical fiber whereupon a significant portion of the light contacting the outer surface 76 of the parabolic stream 46 will be reflected back into the core 78. This will cause the parabolic stream 46 to appear to fluoresce.

The Example shown in FIG. 9 is configured to change the ratio of nozzle inlet 92 size to inner diameter 94 of the slow moving laminar flow zone 100 in front of (upstream of) nozzle inlet 92. Portions of the outer surface 110 of the transfer tube 98 and inner surface 112 of the adjustment nut 96 comprise interoperating helical screw threads that interoperate when rotated relative there to cause longitudinal movement of the adjustment nut 96 relative to the transfer tube 98. A radially projecting tongue 114 extends from the cylinder 38 and engages a circumferential groove 116 in the adjustment nut (or vice versa) to keep the adjustment nut 96 longitudinally positioned relative to the cylinder 38. As the outer adjustment nut 96 is rotated relative to the outer cylinder 38, the outer adjustment nut 96 moves the inner transfer tube 98 forward and back inside the laminar chamber 102. By angling the conic sides 104 aggressively, the velocity of water at the inner surface 106 of the nozzle 44 will change slightly, which will affect the relative speed of the inner core 78 relative to the outer surface 76, thus effecting the point of shear 82 in the parabolic stream.

The transfer tube 98 of one example is tapered internally 106 such that the only point of contact to the laminar jet is the nozzle inlet 92. In one example this angle of taper is between 1 and 5 degrees.

In one example the opening in the end of the nozzle 44 maybe bigger than 0.250". A finger guard 108 may be incorporated to prevent children and other participants from getting stuck/injured in this opening. Thus, it will be desired to have the finger guard longer than a participant's finger, 3" for example.

Several machined steps of different diameters for a series of shoulders may alternatively be used.

The adjustment nut 96 may be rotated by hand, by a crank on the side with gearing, or by a servo with a timing belt or gears. Also a valve to control flow into the laminar flow jet 24 can be installed to affect range.

The two most critical things to laminar flow is the speed/direction of water at the nozzle inlet 92, and a cleanly machined, tapered to knife edge nozzle inlet. Any change to a nozzle's orifice that allows even the slightest turbulence to leak back into the stream at a different direction severely impedes performance of the parabolic stream 46.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A water play feature comprising:

a water supply source;

at least one laminar flow water jet configured to provide a laminar flow water stream for interaction by a participant in a water park;

each laminar flow water jet comprising an outer housing with a water inlet at a first longitudinal end:

the outer housing of each laminar flow water jet having an inlet end open region at the first longitudinal end adjacent the water inlet;

the outer housing of each laminar flow water jet containing a plurality of longitudinal tubes downstream of the inlet end open region and fluidly coupled thereto;

each longitudinal tube extending from the inlet end open region at the first longitudinal end towards a second longitudinal end longitudinally opposed to the first longitudinal end;

wherein the plurality of longitudinal tubes radially fill the outer housing;

the outer housing of each laminar flow water jet having an outlet end open region at the second longitudinal end;

a nozzle fluidly coupled to the second longitudinal end of the outer housing downstream of the outlet end open region;

wherein the inlet end open region comprises a radially outward outer filter chamber fluidly coupled to the water source via an outer inlet;

wherein the inlet end open region comprises a radially inward inner filter chamber radially surrounded by the radially outward outer filter chamber, the radially inward inner filter chamber fluidly coupled to the water source via an inner inlet; and wherein the flow of water entering the radially outward outer filter chamber is controlled independent of the flow of water entering the radially inward inner filter chamber, and a valve positioned between the water supply source and the laminar flow water jet.

2. The water play feature of claim 1, wherein the laminar flow water stream of the water play feature is turned on and off to interact with the participant.

3. The water play feature of claim 1, wherein each laminar flow water jet is rotated in a horizontal plane to interact with the participant.

4. The water play feature of claim 1, wherein each laminar flow water jet is moved to interact with the participant.

5. The water play feature of claim 1, wherein the nozzle includes a plurality of parallel nozzles forming parallel laminar flow water streams, each of the plurality of parallel nozzles fluidly coupled to the same outlet end open region of the outer housing.

6. The water play feature of claim 5, wherein jet valves are provided on each laminar flow water jet forming the laminar flow streams, and each jet valve is configured to be actuated independent of the other jet valves.

7. The water play feature of claim 1, further comprising a lighting device configured to project light in the laminar flow water stream.

8. The water play feature of claim 7, wherein the lighting device is configured to project colored light in the laminar flow water stream.

9. The water play feature of claim 1 further comprising:

a conic end wall at an outlet end of the outlet end open region;

the nozzle having an inlet extending longitudinally into the region radially bounded by the conic end wall; and wherein the nozzle inlet is longitudinally positionable.

10. The water play feature of claim 9 further comprising:

an adjustment nut rotatably coupled to the outer housing;

the adjustment nut having a region of female threads therein; and the nozzle having a region of male threads thereon such that as the adjustment nut is rotated relative to the nozzle, the nozzle inlet repositions longitudinally within the region radially bounded by the conic end wall.

11. The water play feature of claim 9 wherein the nozzle has an inner surface tapered outward from the nozzle inlet.

* * * * *